US012213576B2

(12) United States Patent
Ahrens

(10) Patent No.: US 12,213,576 B2
(45) Date of Patent: Feb. 4, 2025

(54) REINFORCED HAIR HOLDER

(71) Applicant: Hair4Good, LLC, Wilton, CT (US)

(72) Inventor: Mary Ahrens, Wilton, CT (US)

(73) Assignee: Hair4Good, LLC, Wilton, CT (US)

( * ) Notice: Subject to any disclaimer, the term of this patent is extended or adjusted under 35 U.S.C. 154(b) by 159 days.

(21) Appl. No.: 16/560,784

(22) Filed: Sep. 4, 2019

(65) Prior Publication Data

US 2020/0069023 A1 Mar. 5, 2020

Related U.S. Application Data

(60) Provisional application No. 62/726,515, filed on Sep. 4, 2018.

(51) Int. Cl.

*A45D 8/34* (2006.01)
*A45D 8/00* (2006.01)
*A45D 8/36* (2006.01)

(52) U.S. Cl.

CPC ..... *A45D 8/34* (2013.01); *A45D 8/36* (2013.01); *A45D 8/004* (2021.01)

(58) Field of Classification Search

CPC ... A45D 8/00; A45D 8/34; A45D 8/36; A45D 8/38; A42C 5/00; A42C 5/02; A44C 5/00; A44C 5/007; A44C 5/0053; A44C 5/20; A44C 5/2009; A41D 20/00; A41D 20/005; A63B 21/065; B68B 5/04; Y10T 24/314; Y10T 24/316

See application file for complete search history.

(56) References Cited

U.S. PATENT DOCUMENTS 5,758,671 A * 6/1998 Thim ..... A44C 5/0053 132/273
5,826,598 A * 10/1998 Meehan ..... A45D 8/34 132/273
6,047,708 A * 4/2000 Panel ..... A45D 8/34 132/200
7,305,996 B2 * 12/2007 Kraft ..... A45D 8/34 132/273
7,328,710 B2 * 2/2008 Hall ..... A45D 2/02 132/208

(Continued)

FOREIGN PATENT DOCUMENTS

EP 3326488 A1 * 5/2018
WO WO-2019040391 A1 * 2/2019 ..... A46B 15/0018

OTHER PUBLICATIONS

EP 3326488 A1. Translated document (Year: 2018).*

*Primary Examiner* — Cris L. Rodriguez
*Assistant Examiner* — Karim Asqiriba
(74) *Attorney, Agent, or Firm* — Potomac Law Group, PLLC; Jamaica Szeliga

(57) ABSTRACT

A reinforced hair holder, includes a core body having a first core end and a second core end, a cover body having a first cover end and a second cover end, the cover body coupled to the core body along a length of the hair holder and a coupling member that is adapted to couple the first core end and the first cover end to the second core end and the second cover end, respectively. The hair holder provides improved durability that reduces the occurrence of elastic fatigue and breakage to allow a user to limit the frequency of disposal and replacement of a hair holder for the user.

13 Claims, 6 Drawing Sheets

(56) References Cited

U.S. PATENT DOCUMENTS

| | | | | |
|---|---|---|---|---|
| 7,637,266 | B1 * | 12/2009 | Gibbons | A45D 8/36 132/275 |
| 2006/0157077 | A1 * | 7/2006 | Kraft | A45D 8/34 132/200 |
| 2014/0048094 | A1 * | 2/2014 | Carriedo | A45D 8/00 132/210 |
| 2014/0096788 | A1 * | 4/2014 | Krasniansky | A45D 8/34 132/273 |
| 2014/0250566 | A1 * | 9/2014 | Stegerhoek | A45D 8/36 2/209.3 |
| 2016/0213120 | A1 * | 7/2016 | Sze | A45D 8/34 |
| 2017/0049208 | A1 * | 2/2017 | Trelles-Tvede | A45D 8/34 |

* cited by examiner

REINFORCED HAIR HOLDER

RELATED APPLICATION

The present application claims priority from U.S. provisional patent application Ser. No. 62/726,515 filed Sep. 4, 2018, the entirety of which is incorporated herein by reference.

FIELD OF THE INVENTION

The present disclosure relates to a hair holder, and more particularly to a reinforced hair holder with improved durability.

BACKGROUND OF THE INVENTION

Hair accessories can be purely decorative, but more commonly are used to create a particular hair style and maintain the hair style for a desired period of time. One category of hair accessories are hair holders, which hold hair using the tensile strength and flexibility inherent in the material of the hair holder. Hair holders include, but are not limited to, hair elastics, hair ties, headbands, head wraps, hair wraps, scrunchies, twisters, ponytailers, turbans, and hair scarves.

Conventional hair holders fail to maintain their hair-holding properties for an extended period of time. One such hair holder is a hair elastic, which is a ring-shaped object with elasticity. The conventional hair elastic is typically made of rubber, elastic, and/or silicone, or has a core of such materials surrounded by plastic, fabric, thread, etc. These conventional hair elastics have become disposable items in that they may last only a couple of uses. Currently, the materials and construction of the hair elastic is such that elastic fatigue quickly occurs within the hair elastic, reducing the strength of the hair elastic and as a result, reducing the hair holding ability of the hair elastic. In addition, other types of hair holders also have similar problems in that structural damage to the hair holder easily occurs, negatively affecting its hair holding abilities Once the hair holding abilities of the hair holders are reduced, users typically dispose of the current hair holder and purchase replacements. The disposal of such hair holders, as well as their manufacture, creates a substantial amount of waste, much of which cannot be easily processed and which is not environmentally friendly.

SUMMARY

The present invention encompasses reinforced hair holders with improved durability that reduce the occurrence of elastic fatigue and breakage and allows a user to limit the frequency of disposal and replacement of said hair holder. In other embodiments, the present invention also provides a hair holder that reduces waste and is more environmentally friendly than other hair holders. In further embodiments, the present invention includes hair holders that can be used as survival and defense tools.

According to one embodiment of the present invention, the hair holder includes a core body having a first core end and a second core end, a cover body having a first cover end and a second cover end, and a coupling member to couple the first core end and the first cover end to the second core end and the second cover end respectively, wherein either or both of the core body and cover body comprises one or more reinforcement materials. According to other embodiments, the reinforcement materials include one or more of a para-cord, anti-ballistic nanocomposites, spider silks and spider-type silks, protein-based fibers, para-aramid materials such as Kevlar®, meta-aramid materials such as Nomex®, polytetrafluoroethylene ("PTFE") and perfluoroalkoxy polymer resin ("PFA") including Teflon®, flexible steel fibers and composites thereof such as Flexo®, anti-ballistic nanocomposites, self-reinforced composites, and/or graphene, graphene-type materials, and/or other allotropes of carbon. In certain specific embodiments, the core body may comprise graphene or graphene-type materials. In another specific embodiment, the core body and the cover body may both comprise spider silk or spider silk-type material.

In certain embodiments, the coupling member is a glue or comprises a glue portion. In certain embodiment, the glue or glue portion of the coupling member contains one or more of the reinforcement materials useful for the core body and cover body, including but not limiting to the exemplary reinforcement materials listed above. As non-limiting examples only, 0.01%, 0.1%, 1.0%, 3.0%, 5.0%, 10.0%, 20% or more of the weight of the glue may contain one or more of the reinforcement materials described above.

In certain embodiments, the core body and the cover body also may coupled to each other in whole or in part. In other embodiments, the core body may be disposed within the cover body, wherein the outer surface of the core body is disposed substantially adjacent to the inner surface of the cover body. In other embodiments, the core body may be disposed within the cover body but a gap may exist between the outer surface of the core body and the inner surface of the cover body.

According to one embodiment of the present invention, the cover body of the hair holder may include a groove formed on the cover body into which the core body may be inserted. In certain embodiments, the core body is removably disposed within the cover body such that an outer surface of the core body is disposed substantially adjacent to an inner surface of the cover body.

According to another embodiment of the present invention, the cover body of the hair holder is a porous or net structure that may optionally comprise a decorative pattern. The hair holder may also have a cover body that is opaque such as to permit the viewing of the core body.

In certain embodiments, the cover body of the hair holder are wound around the core body. In certain embodiments, the core body and the cover body are plaited and twisted together. In certain embodiments, the cover body is a spiral wound around the core body.

According to one embodiment, the cover body is coated with a material adapted to provide grip.

In certain embodiments of the present invention, the core body and the cover body of the hair holder are substantially ring shaped and lack seams. In such an embodiment, a coupling member is not needed.

In other embodiments of the present invention, the hair holder includes a first strip body and a second trip body wherein the first strip body and the second strip body are substantially rope shaped and wherein either or both of the first strip body and second strip body comprises one or more reinforcement materials. According to other embodiments, the reinforcement materials include one or more of a para-cord, anti-ballistic nanocomposites, spider silks and spider-type silks, protein-based fibers, para-aramid materials such as Kevlar®, meta-aramid materials such as Nomex®, polytetrafluoroethylene ("PTFE") and perfluoroalkoxy polymer resin ("PFA") including Teflon®, flexible steel fibers and composites thereof such as Flexo®, anti-ballistic nanocomposites, self-reinforced composites, and/or graphene, graphene-type materials, and/or other allotropes of carbon. In one embodiment, the first strip body and the second strip body are optionally coupled to each other along the length of the body. In certain embodiments, the first strip body is disposed within the second strip body. In other embodiments, the first strip body and second strip body are maintained in a substantially horseshoe-shape so as to form a headband.

BRIEF DESCRIPTION OF THE DRAWINGS

The above objectives and advantages of the present invention will become more readily apparent to those ordinarily skilled in the art after reviewing the following detailed description and accompanying drawings, in which.

DETAILED DESCRIPTION OF EMBODIMENTS

Figure 1:
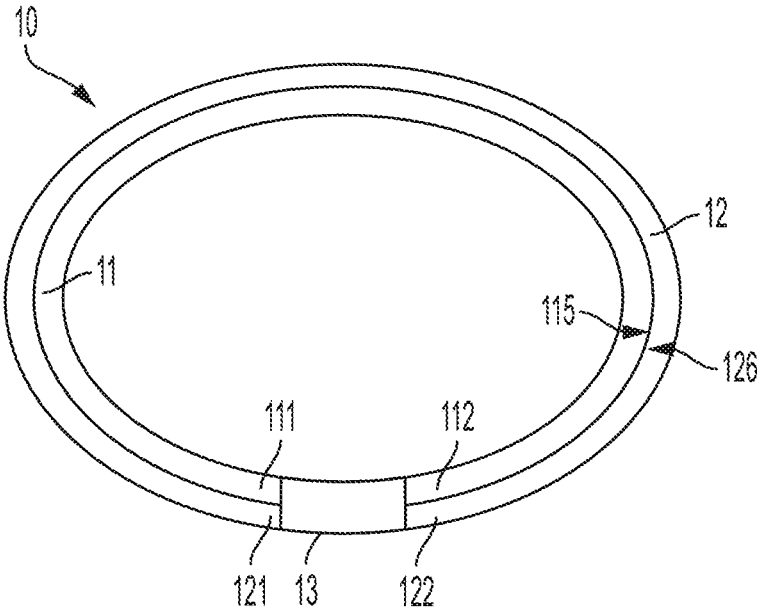
FIG. 1 is a schematic diagram illustrating a hair holder according to one embodiment of the present disclosure.

Reference will now be made in detail to the embodiments of the present disclosure, examples of which are illustrated in FIGS. 1-7. The reference numerals used in the detailed description of the embodiment below correspond to the reference numerals used in the accompanying drawings. While these embodiments are described in sufficient detail to enable those skilled in the art to practice the disclosure, it should be understood that other embodiments may be realized, and that logical and physical changes may be made without departing from the spirit and scope of the invention. Thus, the detailed description herein is presented for purposes of illustration only rather than as limitations. Moreover, references to a singular embodiment may include plural embodiments, and references to more than one component may include a singular embodiment.

The present invention encompasses hair holders with improved durability that reduces the occurrence of elastic fatigue and breakage and allows a user to limit the frequency of disposal and replacement of said hair holder. In other embodiments, the present invention also provides a hair holder that reduces waste and is more environmentally friendly than other hair holders. In further embodiments, the present invention includes hair holders that can be used as survival and defense tools.

FIG. 1 is a schematic diagram illustrating a hair holder 10 according to an embodiment of the present invention is described. The ring-type hair holder 10 shown in FIG. 1 has an improved durability to prevent elastic fatigue of the hair holder 10 and reduce waste created by disposal of said hair holder. The hair holder 10 includes a core body 11 and a cover body 12, each of which is configured into a substantially ring-like shape. In alternative embodiments, not shown, the core body 11 and the cover body 12 may be any other closed geometric shape adapted to provide sufficient strength for hair fastening. The core body 11 and/or the cover body 12 are comprised of one or more reinforcement materials, as described later in this specification.

As indicated in FIG. 1, the core body 11 may include a first end 111 and a second end 112 that are connected and fixed together. The cover body 12, in turn, may include a first end 121 and a second end 122, which are also are connected and fixed together. In certain embodiments, and as shown in FIG. 1, the hair holder 10 may also include a coupling member 13 that is adapted to secure the two ends 111, 112 of the core body 11 and the two ends 121, 122 of the cover body 12 together. In certain embodiments, the coupling member 13 may be a glue or include a glue portion adapted to glue the first end 111 of the core body 11 and the first end 121 of the cover body 12 to the second end 112 of the core body 11 and the second end 122 of the cover body 12, respectively. The glue or glue portion may be made of any known fluid adhesives, including animal based adhesives, plant based adhesives, solvent-type glues, and synthetic glues. The reinforcement materials useful for the core and cover body may also be added to the glue or glue portion for the coupling member. In certain embodiments, the amount of the reinforcement materials added may be between a 0.01% to 20% by weight of the glue. Alternatively, in another embodiment not shown, at least one of the core body 11 and/or the cover body 12 of the hair holder 10 may be a seamless closed ring body formed by known manufacturing processes, such as via a molding or extrusion, etc., or may be seamless like a silicone elastic. In such an embodiment, where both the core body 11 and the cover body 12 are seamless, the hair holder 10 may thus not necessarily include a coupling member 13.

In certain embodiments, the outer boundary 115 of the core body and the inner boundary 126 of the cover body 12 may be coupled in whole or in part by glue, sewing, riveting, crimping, touch fasteners, heat bonding, or any other suitable fixing method. The coupling method may be selected so as to allow the core body 11 to support a substantial portion of a pull force applied on the hair holder 10, such as the force applied while wrapping the hair holder around hair.

In certain embodiments, the cover body 12 may be made of at least one material including but not limited to stretchable rubber, woven elastic, fabrics, plastics, and the like. Additionally, in some embodiments, the cover body 12 may be made of material that is mold, mildew, rot, and UV fade resistant, or is coated or infused with treatments that resist mold, mildew, rot, and UV fading, to further enhance the durability of the hair holder 10. In other embodiments, the cover body 12 may be antibacterial, antimicrobial, and sweat-resistant to provide hygienic, survival, and/or defense properties to the hair holder 10. In certain embodiments, the cover body 12 may be made of the reinforcement materials described below to be used for the core body 11 of the hair holder 10, thus providing at least two reinforced components to the hair holder.

In certain embodiments, the core body 11 of the hair holder 10 may be made of at least one reinforcement material that can enhance the tensile strength of conventional hair holders. The core body 11 may be made of a single reinforcement material or may be made from a combination of two or more materials, wherein at least of such material is a reinforcement material that is substantially strong and tough to enhance tensile strength of the hair holder 10 compared to conventional hair holders. When more than one material is used for the core body 11, the materials may mixed, melded, braided, intertwined, twisted, tied, or connected and coupled in any way.

As non-limiting examples only, the reinforcement materials from which the core body 11 may be made include paracord, anti-ballistic nanocomposites, spider silks and spider-type silks, protein based fibers, para-aramid materials such as Kevlar®, meta-aramid materials such as Nomex®, polytetrafluoreoethylene ("PTFE") and perfluoroalkoxy polymer resin ("PFA") including Teflon®, flexible steel fibers and composites thereof such as Flexo®, anti-ballistic nanocomposites, self-reinforced composites, and/or graphene, graphene-type products, other allotropes of carbon in any 2-dimensional or 3-dimensional arrangement.

In one embodiment, the core body 11 may be made of or contain paracord. Paracord, which is also known as parachute cord, is a substantially lightweight material. Paracord is a nylon kernmantle rope constructed with an interior region of strands that are protected by a woven exterior sheath designed to optimize strength, durability, and flexibility. When used as the core body 11, the number of strands in the interior region of paracord may be increased or decreased based on a desired tensile strength of the hair holder 10. Specifically, the more inner strands used in the paracord, the more the hair holder 10 increases in tensile strength. In certain embodiments of the present invention, the inner strands of paracord are chosen to provide up to about 550 lbs. of tensile strength, far exceeding the conventional hair elastic, which can pass a pull test of only approximately or typically 7-12 lbs. Because the core body 11 can support most of the pull force to prevent from structural damage, the durability of the hair holder is significantly enhanced and massive waste of the hair elastic can be avoided without needing to frequently discard and replace broken hair elastics.

The embodiment of hair holder 10 using paracord in the core body 11 may maintain a significant portion of its tensile strength even if a few inner strands of the paracord are removed. Because of this property, such an embodiment of hair holder 10 using paracord in the core body 11 may be used in emergency situations by removing strands from the interior region of the paracord to serve as survival tools, such as fishing line, sutures, or snares, when no alternative tools are available. The inner strands of paracord may also be braided or woven into a stronger rope or band. Alternatively, in an emergency, the entire hair holder 10 wherein the core body 11 uses paracord can be used for holding a heavy load or fixing designated objects to escape dangers and risks due to the increased tensile strength of such a hair holder 10. Advantageously, the smooth core body 11 will not hurt hands of the user.

In other embodiments of the hair holder 10, the inner strands of the paracord can be woven or unwoven and directly used in the core body 11 of the hair holder 10 without a woven exterior sheath, i.e., "naked strands" from the paracord may be used. A hair holder 10 using such paracord naked strands is substantially soft and substantially flexible while retaining high tensile strength and durability.

In certain embodiments of the hair holder 10, the core body 11 may also include natural, artificial, or genetically enhanced spider silk or spider silk-type material. Spider silk is one of the sturdiest materials found in nature and is stronger than steel. A length of spider silk can be stretched several times in length before it breaks. Several artificial spider silks have been developed to replicate natural spider silk, and genetically altered spider silk also has been made.

In certain embodiments of the hair holder 10, the core body 11 may also include protein-based fibers. Protein-based fibers are derived from natural animal, plant, or insect sources. According to the invention, any source of protein-based fiber may be used so long as it enhances the strength, resiliency, and/or elasticity of the hair holder 10 compared to a standard hair holder.

In certain embodiments of the hair holder 10, the core body 11 may also include para-aramid materials such as Kevlar®. Kevlar® (poly-p-phenylene terephthalamide) is a heat-resistant and strong synthetic fiber with high tensile strength-to-weight ratio. Several grades of Kevlar® are available with different properties, e.g. high modulus, high-elongation, flexible, high fatigue resistant, high tensile strength. According to the present invention, any grade of Kevlar® may be used for the core body 11 of the hair holder 10.

In other embodiments of the hair holder 10, the core body 11 may also include a meta-aramid material such as Nomex®. Nomex® is a flame-resistant meta-aramid material that is rigid and durable. More specifically, Nomex® has excellent thermal, chemical, and radiation resistance properties.

In other embodiments of the hair holder 10, the core body 11 may also include polytetrafluoreoethylene ("PTFE") and/or perfluoroalkoxy polymer resins, such as Teflon,® a non-reactive material with high strength, toughness, self-lubrication, flexibility, thermal resistance and corrosion resistance. In certain embodiments, flexible steel fibers as well as Flexo® PET (PT) (polyethylene terepthalate (PET) monofilament yarns) may be used for the core body 11. Such fibers have a wide operating temperature range, and are resistant to chemical degradation, UV radiation, and abrasion. Further, other Techflex braided sleeving products, and Teckflex and Nassa type products may also be used within the core body 11.

In certain embodiments of the hair holder 10, the core body 11 may also include an anti-ballistic nanocomposite material. As an example, the anti-ballistic nanocomposite, such as that developed by Novana, Inc., can absorb and dissipate incoming ballistic energy or high impact projectile piercing energy and has the ability to self-heal by trapping the incoming projectiles inside the matrix. This reinforcement material can form a lighter and thinner object with good anti-impact performance compared with other material.

In certain embodiments of the hair holder 10, the core body 11 may also include a self-reinforced composite, examples of which also have been developed by Novana, Inc. Such self-reinforced composites have a high-strength core with high melting point. The material is recyclable to reduce waste.

In certain embodiments of the hair holder 10, the core body 11 may also include graphene, a graphene-type product, or any other allotrope of carbon in any 2-dimensional or 3-dimensional arrangement. Graphene and graphene-type products, as examples only, have significant stretching properties and have extremely high tensile strength. In one embodiment, graphene or graphene-type products can be added to silicone or silicone-type products to increase the strength of the core body 11. In other embodiments, graphene or graphene-type products can be added to rubber, nylon, or other materials to increase the strength of the core body 11.

Additionally, in some embodiments, the core body 11 may be made of material that is mold, mildew, rot, and UV fade resistant, or is coated or infused with treatments that resist mold, mildew, rot, and UV fading, to further enhance the durability of the hair holder 10. In other embodiments, the core body 11 may be antibacterial, antimicrobial, and sweat-resistant to provide hygienic, survival, and/or defense properties to the hair holder 10.

In further embodiments, one or more of the reinforcement materials suitable for the core body 11 may be added to glue that couples the core body 11 to the cover body 12 or that connects connect the ends 111 and 112 of the core body 11 or the ends 121 and 122 of the cover body 12. In certain embodiments, the amount of the reinforcement materials added to such glue may be between a 0.01% to 20% by weight. In one preferred embodiment, a 1% by weight of graphene is added to the glue.

When the reinforcement material used for the core body 11 is in the form of threads, the threads may be crocheted, braided, twisted, intertwined, or otherwise coupled in advance to enhance strength. According to the present invention, the thread number is not limited and may be any number based on the desired properties of the hair holder 10.

In addition to the core body 11, the reinforcement materials for the core body 11 can be selected for the cover body 12 of the hair holder 10. Such a modification does not depart from the present disclosure.

In certain embodiments of the hair holder 10, the cover body 12 optionally may have a porous structure or a net structure adapted to allow light-permeability and/or gas-permeability. Further, the porous structure or the net structure may have a specific pattern or design for different decorative purposes. Additionally, the material of the cover body 12 may be transparent, translucent or opaque to make the core body 11 visible or invisible. Further, the cover body 12 may also be sprayed or coated with a material adapted to provide grip for the user.

Figure 2:
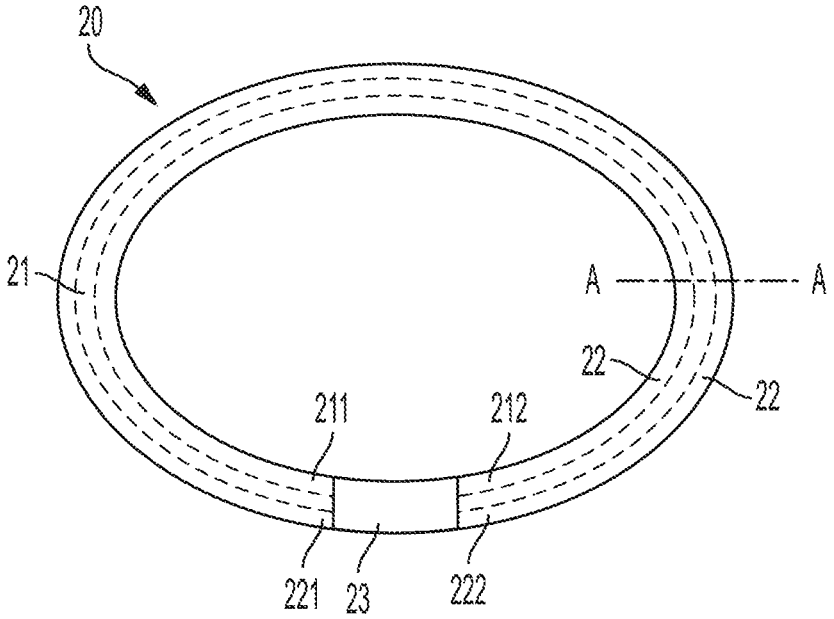
FIG. 2 is a schematic diagram illustrating a hair holder according to another embodiment of the present disclosure.

FIG. 2 is a schematic diagram illustrating a hair holder 20 according to another embodiment of the present disclosure is shown. The hair holder 20 includes a core body 21 and a cover body 22 wherein the core body is located within cover body 22. Similar to the core body 11 described above, the core body 21 may include a first end 211 and a second end 212 that are connected and fixed together; the cover body may include a first end 221 and a second end 222 that are connected and fixed together, and the hair holder 20 may also include a coupling member 23 adapted to secure the two ends 211, 212 of the core body 21 and the two end 221, 222 of the cover body 22 together.

In certain embodiments, the coupling member 23 may be a glue or include a glue portion adapted to glue the first end 211 of the core body 21 and the first end 221 of the cover body 22 to the second end 212 of the core body 21 and the second end 222 of the cover body 22, respectively. The glue or glue portion may be made of any known fluid adhesives, including animal based adhesives, plant based adhesives, solvent-type glues, and synthetic glues. The reinforcement materials useful for the core body 21 may also be added to the glue or glue portion for the coupling member. In certain embodiments, the amount of the reinforcement materials added to the glue or glue portion may be between a 0.01% to 20% by weight of the glue. Alternatively, in another embodiment not shown, at least one of the core body 21 and/or the cover body 22 of the hair holder 20 may be a seamless closed ring body formed by known manufacturing processes, such as via a molding or extrusion. In one embodiment where both the core body 21 and the cover body 12 are seamless, the hair holder 20 may thus not necessarily include a coupling member 23.

In certain embodiments of the hair holder 20, the cover body 22 optionally may have a porous structure or a net structure adapted to allow light-permeability and/or gas-permeability. Further, the porous structure or the net structure may have a specific pattern or design for different decorative purposes. Additionally, the material of the cover body 22 may be transparent, translucent or opaque to make the core body 21 visible or invisible. Further, the cover body 22 may also be sprayed or coated with a material adapted to provide grip for the user.

Figure 3A:
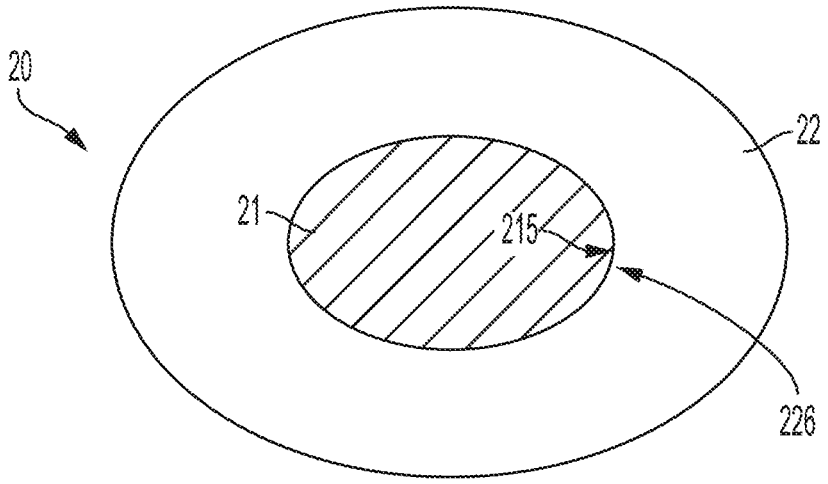
FIG. 3A and FIG. 3B are cross-sectional views of the hair holder in FIG. 2.

FIG. 3A is a cross-sectional view of one embodiment of the hair holder 20 cut along a radial direction (line A-A) indicated in FIG. 2. As shown in FIG. 3A, the core body 21 may be disposed in a channel defined by an inner surface 226 of the cover body 22. The cover body 22 may be adapted to cover and wrap around the core body 21, when the core body 21 is disposed within the cover body. An outer surface 215 of the core body 21 may be in contact with the inner surface 226 of the cover body 22. In this embodiment, the core body 21 is completely surrounded by the cover body 22. Coupling methods such as glue, stitches, glue combined with one or more reinforcement materials, etc. may be provided to bond at least a portion or entirety of the outer surface 215 of the core body 21 and at least a corresponding portion of the inner surface 226 of the cover body 22. The ring bodies can be glued or adhered with a tool to reduce costs. According to an alternative embodiment of the present disclosure (not shown), the hair holder 20 may have a gap (not shown) between the outer surface 215 of the core body 21 and the inner surface 226 of the cover body 22, and the core body 21 and the cover body 22 may not be coupled to each other.

Figure 3B:
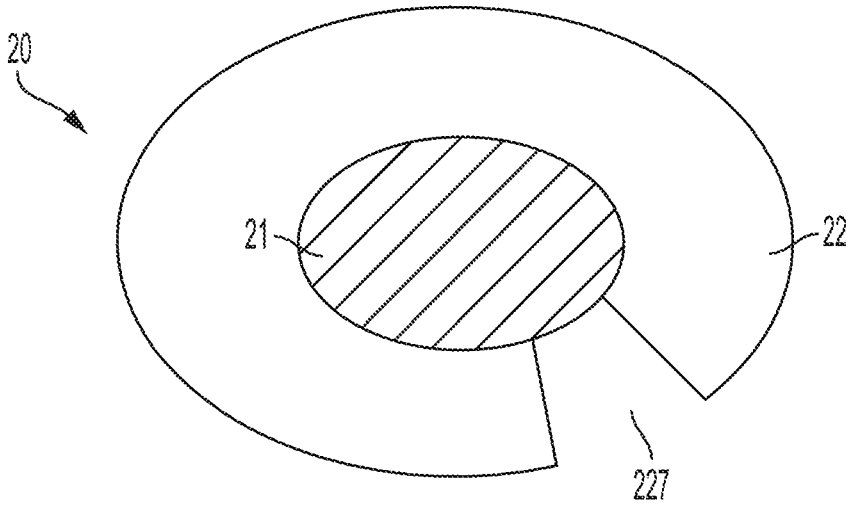

Another embodiment of the hair holder 20 is shown in FIG. 3B. FIG. 3B is also a cross-sectional view of the hair holder 20 cut along a radial direction (line A-A) indicated in FIG. 2.

As can be seen in FIG. 3B, the core body 21 is not completely surrounded by the cover body 22. The cover body 22 may have a groove 227 that is formed on the cover body 22. The core body 21 may be coupled to the cover body 22 by using any coupling method such as glue, stitches, glue combined with one or more reinforcement materials, etc. Alternatively, according to one embodiment, the core body 21 may be detachable from the cover body 22. In such an embodiment of the hair holder 20, which allows the core body 21 to be removed, cleaned, and/or replaced, the core body 21 may be pressed into the cover body 22 through the groove 227 to form the reinforced hair holder 20, and/or the core body 21 may be removed from the cover body 22 by pulling the core body 21 away from the cover body 22 through the groove 227. In certain embodiments, the core body 21 is able to be detached from the cover body 22 through the groove 227 because the cover body 22 is stretchable and able to expand. In other embodiments, the core body 21 is able to be detached from the cover body 22 through the groove 227 because the core body 21 is stretchable and able to contract. In other embodiments, the core body 21 is able to be detached from the cover body 22 through the groove 227 because both the cover body 22 and the core body 21 are stretchable.

The materials of the core body 21 and cover body 22 of hair holder 20, and the related advantages and functions thereof, are substantially similar to the core body 11 and cover body 12 of hair holder 10, respectively, described above. Such discussion of the core body 11 and cover body 12 is herein incorporated by reference.

Figure 4A:
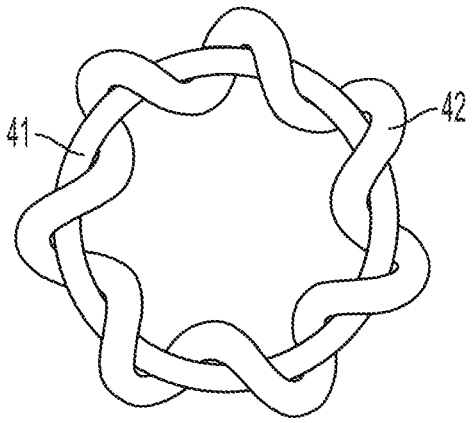
FIGS. 4A-4C are schematic diagrams illustrating variations of the hair holders.
Figure 4B:
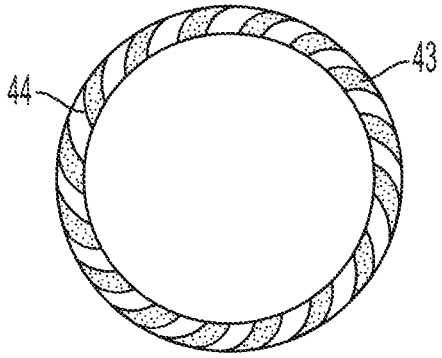
Figure 4C:
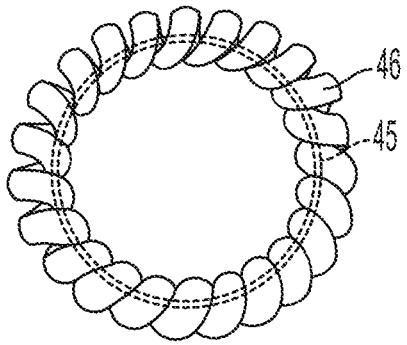

FIGS. 4A, 4B, and 4C are schematic diagrams illustrating exemplary variations of the ring-type hair holders of hair holder 10 and hair holder 20. As shown in FIG. 4A, the cover body 42 may be wound around the core body 41. While, the cover body 42 is illustrated as winding around the core body 41 seven times, the cover body 42 may be modified to wind around the core body any number of times. As shown in FIG. 4B, the core body 43 and the cover body 44 may be plaited and twisted together to form the substantially ring-type hair holder. As shown in FIG. 4C, the cover body 46 is a spiral wound around the core body 45. The materials of the core bodies 41, 43, and 45, and the related advantages and functions thereof, are substantially similar to the core body 11 described for hair holder 10 and the core body 21 described for hair holder 20. Likewise, the materials of the cover bodies 42, 44, and 46, and the related advantages and functions thereof, are substantially similar to the cover body 12 of hair holder 10 and the cover body 22 of hair holder 20, described above. Such discussions of the core bodies 11 and 21 and the cover bodies 12 and 22 are herein incorporated by reference.

Figure 5:
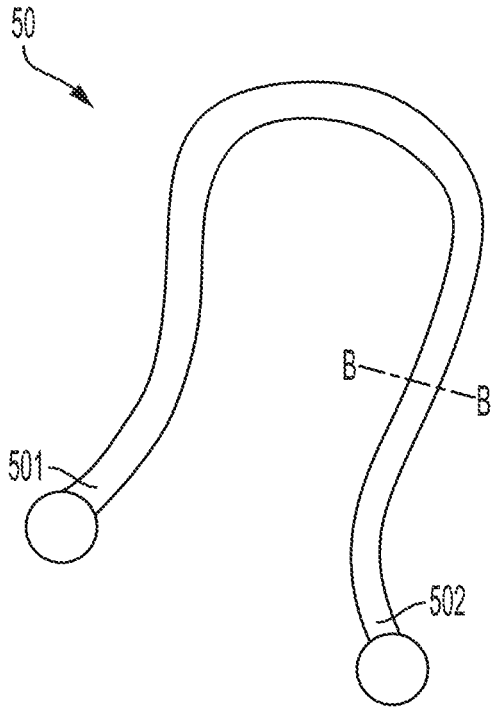
FIG. 5 is a schematic diagram illustrating a hair holder according to a further embodiment of the present disclosure.
Figure 6A:
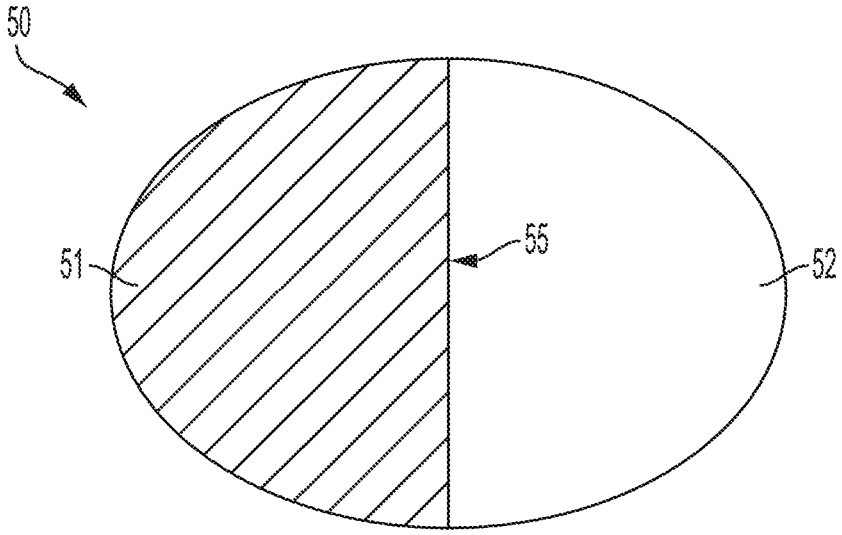
FIGS. 6A-6C are cross-sectional views of the hair holder in FIG. 5.
Figure 6B:
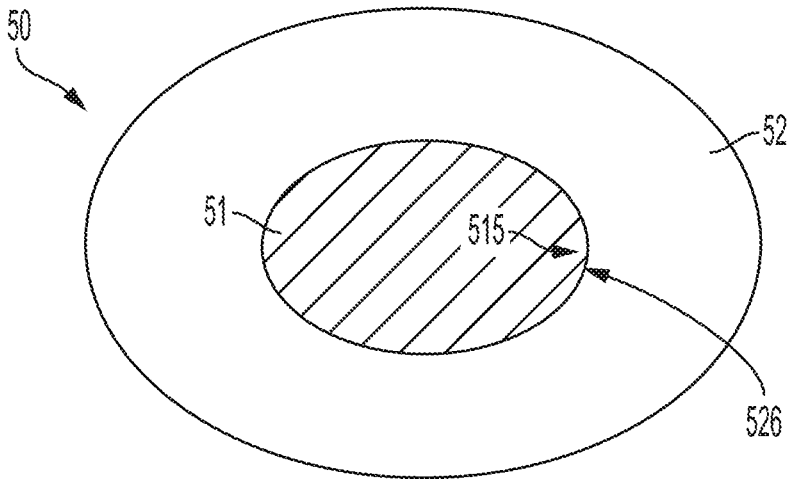
Figure 6C:
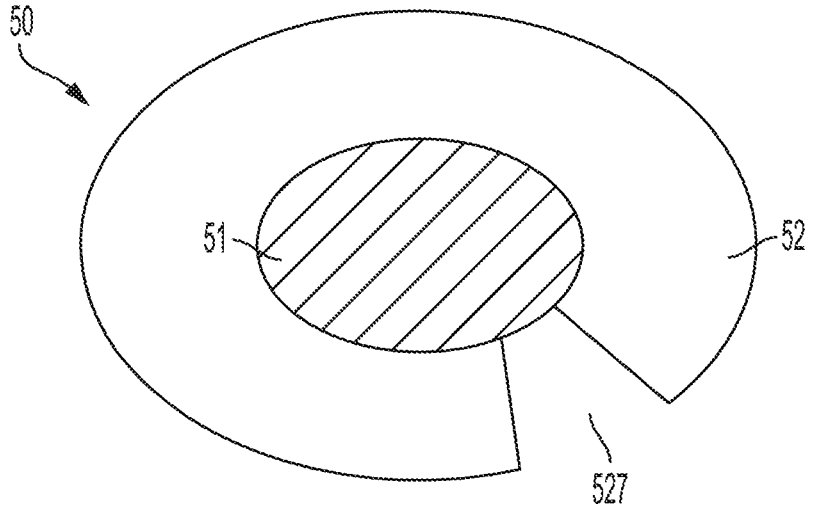

FIG. 5 is a schematic diagram illustrating a hair holder 50 according to a further embodiment of the present invention. The hair holder 50 is a rope-type hair holder. The hair holder 50 may be substantially similar to the hair holders 10, 20 described above, however a user may need to tie the ends 501, 502 together to use the hair holder 50 for hair holding. In certain embodiments of the hair holder 50, the hair holder 50 may include a first strip body 51 and a second strip body 52, as shown in FIGS. 6A-6C. In certain embodiments, the first strip body 51 and second strip body 52 may have a contact surface 55 where the first strip body 51 and the second strip body 52 contact each other along the length of the hair tie 50.

FIGS. 6A-6C illustrate cross-sectional views of the hair holder 50 cut along a thickness direction (line B-B) according to different embodiments of the present invention.

As shown in FIG. 6A, according to one embodiment, the first strip body 51 and the second strip body 52 may be fixed together along a length of the hair holder 50 from the first end 501 to the second end 502 using any suitable coupling method. The contact surface 55 between the first strip body 51 and the second strip body 52 may be a flat surface, a curved surface, an irregular surface, or any other suitable surface with the first strip body and second strip body 52 contacting each other.

As shown in FIG. 6B, according to an embodiment, the first strip body 51, that is substantially the same as the core bodies 11, 21 described above, may be disposed within the second strip body 52, that is substantially similar to the cover bodies 12, 22 described above. As shown in FIG. 6B, the first strip body 51 may be completely surrounded by the second strip body 52. The outer surface 515 of the first strip body 51 may be in contact with the inner surface 526 of the second strip body 52. Coupling methods glue, stitching, glue combined with one or more reinforcement materials, etc. may be provided to bond at least a portion of the outer surface 515 of the first strip body 51 and at least a corresponding portion of the inner surface 526 of the second strip body 52. According to an alternative embodiment of the present disclosure (not shown), the hair holder 50 may have a gap (not shown) between the outer surface 515 of the first strip body 51 and the inner surface 526 of the second strip body 52, and the first strip body 51 and the second strip body 52 may not be coupled to each other.

As can be seen in FIG. 6C, according to one embodiment, the first strip body 51 is not completely surrounded by the second strip body 52. The second strip body 52 may have a groove 527 is formed on the second strip body 52. The first strip body 51 may be coupled to the second strip body 52 by using any coupling method such as glue, stitches, etc. Alternatively, according to one embodiment, the first strip body 51 may be detachable from the second strip body 52. In such an embodiment of the hair holder 50, which allows the first strip body 51 to be removed, cleaned, and/or replaced, the first strip body 51 may be pressed into the second strip body 52 through the groove 527 to form the reinforced hair holder 50, and/or the first strip body 51 may be removed from the second strip body 52 by pulling the first strip body 51 away from the second strip body 52 through the groove 527. In certain embodiments, the first strip body 51 is able to be detached from the second strip body 52 through the groove 527 because the second strip body 52 is stretchable and able to expand. In other embodiments, the first strip body 51 is able to be detached from the second strip body 52 through the groove 527 because the first strip body 51 is stretchable and able to contract. In other embodiments, the first strip body 51 is able to be detached from the second strip body 52 through the groove 527 because both the second strip body 52 and the first strip body 51 are stretchable.

In the embodiments shown in FIG. 6B and FIG. 6C, the second strip body 52 optionally may have a porous structure or a net structure adapted to allow light-permeability or gas-permeability. Further, the porous structure or the net structure may have a specific pattern or design for different decorative purposes. Additionally, the material of the second strip body 52 may be transparent, translucent or opaque to make the first strip body 51 visible or invisible. Further, the second strip body 52 may be sprayed or coated with a material adapted to provide grip to the user.

Similar to the variations of the ring-type hair holders 10 and 20 shown in FIGS. 4A, 4B, and 4C, the second strip body 52 may also be wound around the first strip body 51, the first strip body 51 and the second strip body 52 may be plaited and twisted together to form, or the second strip body 52 may be spiraled around the first strip body 51.

The material of the first strip body 51, and the related advantages and functions thereof, are substantially similar to those described about the core bodies 11, 21 described above. Such discussions of the core bodies 11 and 21 are herein incorporated by reference. Likewise, the material of the second strip body 52, and the related advantages and functions thereof, are substantially similar to those described about the cover bodies 12, 22 described above. Such discussions of the cover bodies 12 and 22 are herein incorporated by reference.

Figure 7:
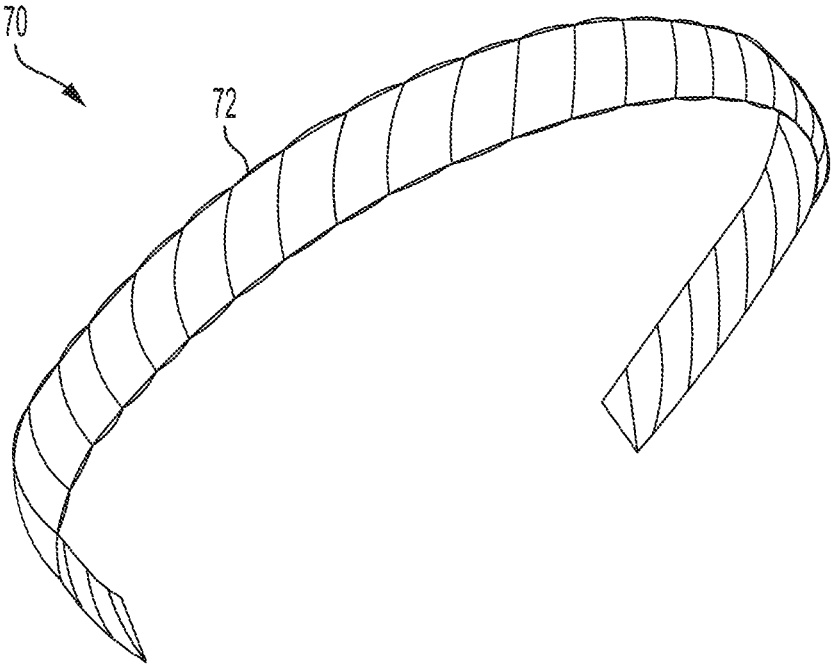
FIG. 7 is a schematic diagram illustrating a hair holder according to a further embodiment of the present disclosure.

FIG. 7 is a schematic diagram illustrating a hair holder 70 according to a further embodiment of the present invention. The hair holder 70 is also known in the art as a headband. For the hair holder 70, a cover body 72 is wound around a core body (not shown) which is substantially horseshoe-shaped. The cover body 72 completely covers the core body so that the hard piece is not exposed. The materials of the cover body 72 and the core body are substantially similar to those used for the cover bodies 12, 22 and the core bodies 11, 21 described above. Such discussions of the cover bodies 12 and 22 and core bodies 11 and 21 are herein incorporated by reference.

The structure of the hair holder in each of the above embodiments may be applicable to all types of hair holders known in the art, e.g. elastics, headband, head wrap, hair wrap, scrunchies, twisters, ponytailers, turbans, hair scarves or other known types of hair fasteners or adornments. As described above, the hair holders of the present invention are reinforced by introducing reinforcement materials, which include but are not limited to paracord, anti-ballistic nano-composites, spider silks and spider-type silks, protein-based fibers, para-aramid materials such as Kevlar®, meta-aramid materials such as Nomex®, polytetrafluoreoethylene ("PTFE") and perfluoroalkoxy polymer resin ("PFA") including Teflon®, flexible steel fibers and composites thereof such as Flexo®, anti-ballistic nanocomposites, self-reinforced composites, and graphene and graphene-type products as well as other allotropes of carbon. The present disclosure is not limited to these reinforcement materials; those of ordinary skill in the art will understand that any suitable material, now known or hereafter developed, may be used in forming the reinforced hair holders of the present invention. The strength, toughness and durability of the reinforced hair holder are enhanced, and the hair holder can hold hair tighter and last much longer than the conventional hair holder, so as to reduce waste of the conventional disposable hair holder.

Although aspects of the present invention are described with respect to holding hair, it should be understood that the various disclosed embodiments can be used in numerous other fields in which a tie or holder type item can be utilized, for example as a survival tool in an emergency, such as a tourniquet. The present disclosure can also be readily applied to other different uses. Accordingly, the present disclosure is not limited to a specific context and be applied in numerous contexts, such as those described above, in addition to other contexts as well. Various applications of the disclosed techniques provide substantial improvements to hair holding tools, such as but not limited to, spin pins, hair sticks, braiders, ponytailing tools, updo tools, and the like.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A hair holder, comprising:

a core body having a first core end and a second core end;

a cover body having a first cover end and a second cover end and an outer surface and an inner surface, wherein a coupling member having a first coupling end opposite to a second coupling end, wherein the first core end and the first cover end, and the second core end and the second cover end connect to the first coupling end and the second coupling respectively;

wherein the cover body further comprises a groove formed on the cover body; wherein the groove extends substantially a full length between the first cover end and the second cover end;

wherein the groove extends through the outer surface of the cover body to the inner surface of the cover body;

wherein the core body is configured to be inserted into the groove of the cover body; and wherein either or both of the core body and cover body comprises a reinforcement material of natural, artificial, or genetically altered spider silk.

2. The hair holder of claim 1, wherein the coupling member connecting the ends of the core body comprises a glue or a glue portion comprising graphene or graphene-type material.

3. The hair holder of claim 1, wherein the core body and the cover body are coupled to each other in whole or in part with a glue comprising graphene or graphene-type material.

4. The hair holder of claim 1, wherein the cover body comprises a porous structure or net structure.

5. The hair holder of claim 4, wherein the porous structure or net structure comprises a decorative pattern.

6. The hair holder of claim 1, wherein the core body comprises the reinforcement material of natural, artificial, or genetically altered spider silk and wherein the cover body is translucent or transparent such as to permit viewing of the natural, artificial, or genetically altered spider silk of the core body.

7. The hair holder of claim 1, wherein the cover body is coated with a material adapted to provide grip.

8. A hair holder, comprising:

a core body having a first core end and a second core end;

a cover body having a first cover end and a second cover end;

a coupling member to couple the first core end and the first cover end to the second core end and the second cover end respectively;

wherein the cover body further comprises a groove formed on the cover body;

wherein the groove extends substantially a full length between the first cover end and the second cover end;

wherein the groove extends through the outer surface of the cover body to the inner surface of the cover body;

wherein the core body comprises a reinforcement material of natural, artificial, or genetically altered spider silk; and wherein the core body and the cover body are coupled to each other in whole or in part with a glue comprising graphene or graphene-type material.

9. The hair holder of claim 8, wherein the coupling member comprises a glue or a glue portion comprising graphene or graphene-type material.

10. The hair holder of claim 8, wherein the cover body comprises a porous structure or net structure.

11. The hair holder of claim 10, wherein the porous structure or net structure comprises a decorative pattern.

12. The hair holder of claim 8, wherein the cover body is translucent or transparent such as to permit viewing of the natural, artificial, or genetically altered spider silk of the core body.

13. The hair holder of claim 8, wherein the cover body is coated with a material adapted to provide grip.

* * * * *